US011701595B2

(12) United States Patent
Chatrath et al.

(10) Patent No.: US 11,701,595 B2
(45) Date of Patent: Jul. 18, 2023

(54) REACTION CONTROLLED SYSTEMS AND METHODS

(71) Applicant: Universal City Studios LLC, Universal City, CA (US)

(72) Inventors: Pratik Sanjay Chatrath, Orlando, FL (US); Benjamin Clark, Orlando, FL (US); Robert Cortelyou, Maitland, FL (US); Timothy J. Eck, Orlando, FL (US); Byron C. Miller, Orlando, FL (US); James B. Winfrey, Orlando, FL (US); Ethan Terwilliger, New York, NY (US); Corey Cox, Orlando, FL (US); Justin Daimler, Melbourne, FL (US)

(73) Assignee: Universal City Studios LLC, Universal City, CA (US)

( * ) Notice: Subject to any disclaimer, the term of this patent is extended or adjusted under 35 U.S.C. 154(b) by 5 days.

(21) Appl. No.: 17/491,249

(22) Filed: Sep. 30, 2021

(65) Prior Publication Data

US 2022/0143518 A1 May 12, 2022

Related U.S. Application Data

(60) Provisional application No. 63/113,003, filed on Nov. 12, 2020.

(51) Int. Cl.
*A63G 7/00* (2006.01)
*A63G 31/02* (2006.01)

(52) U.S. Cl.
CPC ..... *A63G 7/00* (2013.01); *A63G 31/02* (2013.01)

(58) Field of Classification Search
CPC ..... A63G 31/00; A63G 31/02; A63G 31/16; A63J 5/02
USPC ..... 472/75, 80, 81, 83, 84
See application file for complete search history.

(56) References Cited

U.S. PATENT DOCUMENTS

| | | | | |
|---|---|---|---|---|
| 8,286,907 | B2 | 10/2012 | Dohi et al. | |
| 8,876,571 | B2 | 11/2014 | Trowbridge et al. | |
| 8,920,251 | B2 * | 12/2014 | Dietz | A63G 31/02 472/130 |
| 8,961,326 | B2 * | 2/2015 | Fisher | F16M 11/043 472/130 |
| 10,723,454 | B1 | 7/2020 | Hovey et al. | |

(Continued)

OTHER PUBLICATIONS

Gibbs, Samuel, "Disney explores ditching puppets and fireworks for drone-powered displays," The Guardian, Aug. 28, 2014, 6 pages, https://www.theguardian.com/technology/2014/aug/28/disney-puppets-fireworks-drones-patent.

(Continued)

*Primary Examiner* — Kien T Nguyen
(74) *Attorney, Agent, or Firm* — Fletcher Yoder PC

(57) ABSTRACT

A reaction controlled system of includes a track, a trolley that travels along the track, an animated figure coupled to the trolley, at least one reaction control element coupled to a portion of the animated figure (e.g., on the features, limbs, and/or body of the animated figure), and a controller. The controller detects presence of a ride vehicle or a guest. The controller also controls the trolley to position the animated figure based on the presence of the ride vehicle or the guest. The controller also controls animation of the animated figure by operating the reaction control element.

20 Claims, 4 Drawing Sheets

(56) References Cited

U.S. PATENT DOCUMENTS

| | | | | |
|---|---|---|---|---|
| 2010/0227527 | A1* | 9/2010 | Smoot | A63F 9/34 446/362 |
| 2014/0231590 | A1 | 8/2014 | Trowbridge et al. | |
| 2018/0251199 | A1 | 9/2018 | Radford | |
| 2020/0215443 | A1 | 7/2020 | Brister et al. | |
| 2020/0236461 | A1 | 7/2020 | Hall et al. | |
| 2020/0265604 | A1 | 8/2020 | Lin et al. | |

OTHER PUBLICATIONS

Michaelsen, Shannen, "Disney Files Patent for Further Use of Drones to Control Show Elements," WDW News Today, Aug. 28, 2020, 6 pages, https://wdwnt.com/2020/08/disney-enterprises-files-patent-for-further-use-of-drones-to-control-show-elements/.

Cirque de Soleil, "SPARKED: A Live Interaction Between Humans and Quadcopters," Youtube, Sep. 22, 2014, 1 page, https://www.youtube.com/watch?v=6C8OJsHfmpl.

MouseSteps / JWL Media, "X-Wing Drones at Star Wars: Rise of the Resistance Media Event (w/Close-Ups), Hollywood Studios," Youtube, Dec. 4, 2019, 1 page, https://www.youtube.com/watch?v=yLUnOxn9Z48.

Attractions Magazine, "Jurassic Pteranodons Flying Around the Hollywood Sign," Youtube, Jul. 18, 2019, 1 page, https://www.youtube.com/watch?v=plJrVylohDs.

Attractions Magazine, "Harry Potter stars help open Hagrid's Magical Creatures Motorbike Adventure," Youtube, Jun. 12, 2019, 1 page, https://www.youtube.com/watch?v=rS9DKqQMg8U&feature=youtu.be&t=310.

PCT/US2021/057879 International Search Report and Written Opinion dated Feb. 16, 2022.

* cited by examiner

REACTION CONTROLLED SYSTEMS AND METHODS

CROSS-REFERENCE TO RELATED APPLICATION

This application claims priority to and the benefit of U.S. Provisional Application No. 63/113,003, filed Nov. 12, 2020, and entitled "REACTION CONTROLLED SYSTEMS AND METHODS," the disclosure of which is incorporated by reference in its entirety for all purposes.

BACKGROUND

This section is intended to introduce the reader to various aspects of art that may be related to various aspects of the present disclosure, which are described and/or claimed below. This discussion is believed to help provide the reader with background information to facilitate a better understanding of the various aspects of the present disclosure. Accordingly, it is understood that these statements are to be read in this light, and not as admissions of prior art.

The present disclosure relates generally to the fields of entertainment environments, such as amusement parks, theaters, and show sets. Specifically, embodiments of the present disclosure relate to techniques for providing a wide range of movement and motions for show scene features, such as animated characters, in the entertainment environments.

In certain entertainment settings, such as an amusement park setting, animations for amusement park features may be limited in terms of movements and/or motions, with respect to a guest viewing the animations. That is, equipment providing the animations may be limited to animating within a particular distance and/or a particular area. By way of example, the equipment may cause an animated figure to move towards a guest on a ride at the amusement park and within a particular range with respect to the guest. In particular, the animated figure may move within the same area of the ride and/or up to a distance from the guest, and stop due to equipment limitations. The equipment may be fixed at the particular area of the ride (e.g., mounted to a ceiling of a show scene on the ride) and thus, may provide animations restricted to the particular area. As such, the equipment limitations may effectively limit the number and/or range of animations for the animated figure.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In one embodiment, a reaction controlled system includes a track, a trolley that travels along the track, an animated figure coupled to the trolley, at least one reaction control element coupled to a portion of the animated figure, and a controller. The controller detects presence of a ride vehicle or a guest. The controller also controls the trolley to position the animated figure based on the presence of the ride vehicle or the guest. Additionally, the controller controls animation of the animated figure by operating the reaction control element.

In one embodiment, a method for moving an animated figure includes determining a desired location for the animated figure, in which the animated figured is coupled to a trolley. The method also includes moving the trolley along a path based on the desired location, determining an animation for the animated figure, and determining one or more components of the animated figure to move relative to other components of the animated figure based on the animation. Furthermore, the method includes maneuvering the one or more components of the animated figure relative to the other components of the animated figure by controlling one or more reaction controlled elements coupled with, disposed on, or integrated with the one or more components of the animated figure.

In one embodiment, a tangible, non-transitory, machine readable medium, includes machine-readable instructions that, when executed by one or more processors, cause the one or more processors to detect a presence of a guest or a ride vehicle. Moreover, the instructions cause the one or more processors to position a trolley along a path based on the detected presence, in which the trolley is coupled to an animated figure. Additionally, the instructions cause the one or more processors to determine at least one component of the animated figure to control based on an animation. Furthermore, the instructions cause the one or more processors to, in response to determining the at least one component, operate the trolley and at least one reaction controlled element associated with the at least one component to provide the animation, wherein the at least one reaction controlled element is onboard the animated figure and/or connected to the animated figure via a rod.

BRIEF DESCRIPTION OF DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
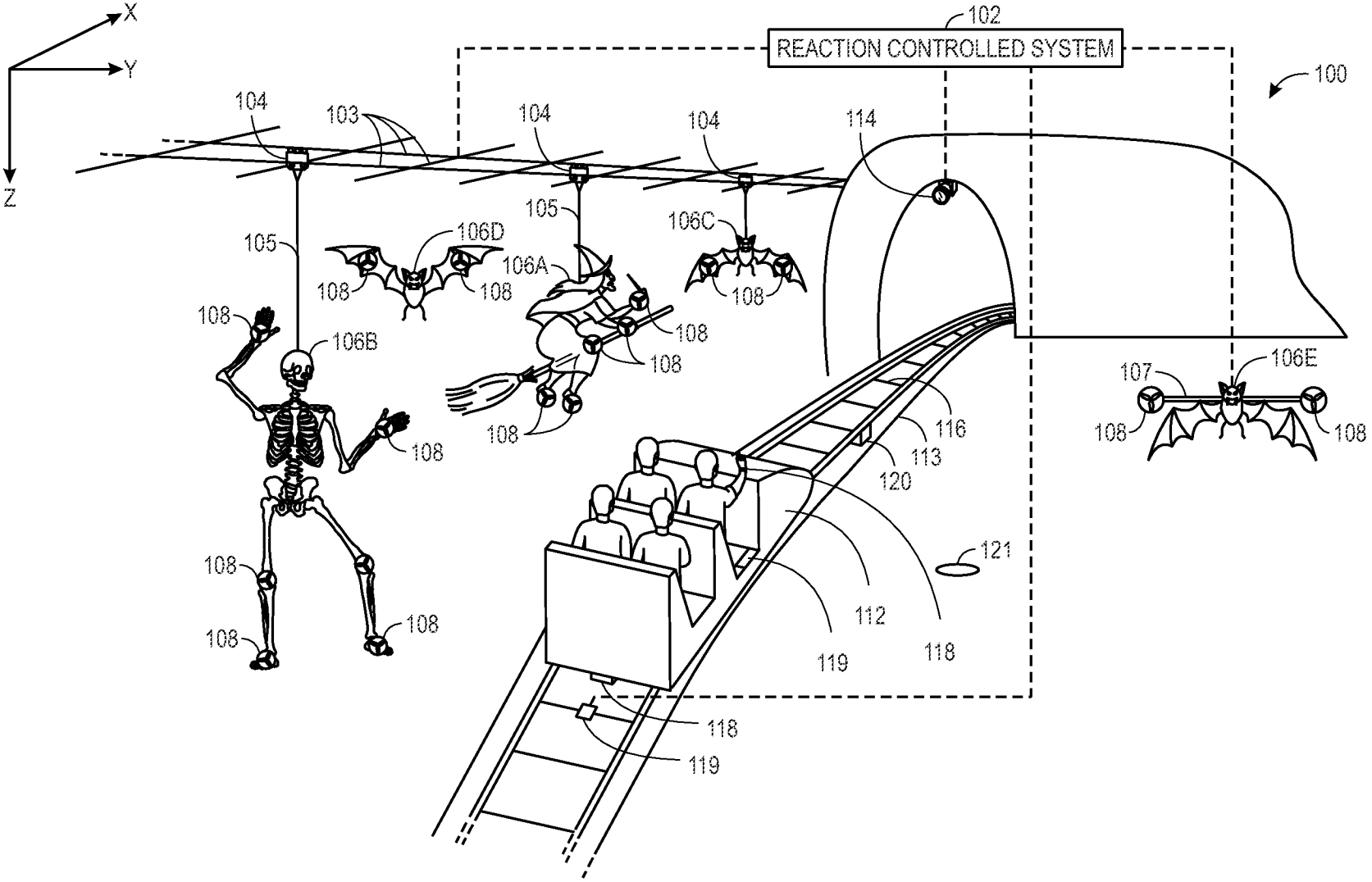
FIG. 1 is a schematic diagram of an amusement park ride with a reaction controlled system, in accordance with an embodiment of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment", "an embodiment", or "some embodiments" of the present disclosure are not intended to be interpreted as excluding the existence of additional embodiments that also incorporate the recited features. Use of the term "approximately" or "near" should be understood to mean including close to a target (e.g., design, value, amount), such as within a margin of any suitable or contemplatable error (e.g., within 0.1% of a target, within 1% of a target, within 5% of a target, within 10% of a target, within 25% of a target, and so on).

As used herein, a "reaction controlled element" may refer to a propeller (e.g., a motor driven propeller, a quadcopter propeller, a clockwise and/or a counter clockwise propeller), an unmanned aerial vehicle (UAV) (e.g., a drone), an electric ducted fan, a pneumatic device, and/or a gyroscope device. A "reaction controlled system" may refer to a system utilizing one or more of the reaction controlled elements and/or an additional movement system (e.g., a trolley system with rails (e.g., rods), trolley, and/or cables) connected (e.g., physically or wirelessly) to one or more show scene features (e.g., amusement park features) to provide animations. The show scene features may include, but are not limited to, an animated figure (e.g., a physical figure, a robotic figure, and/or a displayed figure on an electronic display), a prop, a lighting effect, and/or a sound effect. By way of example, the reaction controlled system may rotate one or more propellers to generate a thrust to cause an animated figure to fly in a particular direction.

As previously discussed, equipment providing animations to the show scene features, such as equipment on a ride, along a pathway, and/or at a show, at an amusement park, may limit the full effect of the animations. In particular, the physical limitations associated with the equipment may hinder the number of animations. The equipment providing the aminations often includes a system of pulleys, cables, robotic arms, and/or other mechanical assemblies. Moreover, the equipment may be orientated and positioned in a manner such that the show scene features remain in a close proximity to the equipment. The close proximity may allow the equipment to have control over the show scene features. As such, by restricting the equipment positions and connections, such as the number of cables and the relative positioning of the cables to prevent entanglement, the animations provided by show scene features may be limited. By way of example, the animation limitations for the animated figure may be associated with movement limitations within a particular area of the amusement park (e.g., a tunnel portion of the ride with the show scene features), distance traveled within the particular area and/or out of the particular area, movement or animation of portions of the animated figure (e.g., upper body or limbs of the animated figure), and so forth.

Further, the equipment may be heavy and/or fixed (e.g., mounted) to the particular area. For example, the robotic arms, lifting assemblies, and/or other mechanical assemblies, may be too heavy to easily move and/or provide mobility for the animations (e.g., lifting the animated figure weighing a couple hundred pounds), without using an extensive amount of energy. As such, it may be desirable for a system to provide a wide range of motion, movement, and/or mobility for the animations. For show scene features including the animated figure, it may also be desirable to provide the wide range of motion, movement, and/or mobility to different portions of the animated figure, and without weighing down the animated figure (e.g., a lighter weight animated figure).

It should be noted that although examples provided herein may be specifically directed to particular aspects of an amusement park, such as mechanical animated figures (e.g., animated figures with propellers) to facilitate a wide range of movements for animations, the techniques in this disclosure may be applied to other conditions and/or contexts. Thus, the present examples should be understood to reflect real-world examples of the amusement park to provide useful context for the discussion, and should not be viewed as limiting further applicability of the present approach. For example, the present disclosure should be understood as being applicable to additional situations in which providing a wide range of motion, movement, and/or mobility, may be utilized. The additional situations may include moving other amusement park features, such as ride carts, ride tracks, and so forth. The present disclosure should also be understood as being applicable to additional animated figures, such as displayed animated figures and/or human animated figures (e.g., lifting human performers during a show event), and additional show scene features, such as props, lighting effects, and/or sound effects (e.g., moving to different portions of a stage at the show event).

With the foregoing in mind, FIG. 1 is a schematic representation of an amusement park ride 100 with a reaction controlled system 102. Specifically, the reaction controlled system 102 may be wired or wirelessly connected (as depicted by the dashed lines) to different show scene features, sensors, and a trolley system of the amusement park ride 100. The "trolley system" may refer to a combination or collection of rails 103 and trolleys 104. The positioning of the rails 103 may be parallel and perpendicular, creating multiple horizontal and vertical pathways. That is, the rails 103 may be connected and spaced in a manner that creates multiple horizontal and vertical paths to move through an x-axis and a y-axis of a linear axes system. In other embodiments, the rails 103 may be curvilinear (e.g., non-linear), such that the rails 103 include curves, turns and intersections to guide the trolleys 104 through circuitous routes and turn onto different paths. That is, the rails 103 may be multidimensional to guide the trolleys 104 in the multidimensional space (e.g., the x-axis and/or the y-axis). In some embodiments, such as embodiments in which the amusement park ride 100 is a roller coaster track or the like, the rails 103 may also move through a z-axis to guide the trolleys 104 through the x-y-z axes of the linear axes system.

Although the depicted embodiment shows the rails 103 positioned and extending within a particular area of the amusement park ride 100, such that animations may be provided within a threshold distance (e.g., inside and outside) from the particular area, the systems and methods described herein may use rails 103 that extend over the entire area (e.g., ceiling, ground, walls, and so forth) of the amusement park ride 100. By way of example, the reaction controlled system 102 may provide animations in other areas of the amusement park ride 100, such as above a guest, as the guest moves along the amusement park ride 100. By way of another example, the reaction controlled system 102 may provide animations along the ride path and/or on the ground of the ride path, by rails 103 that are placed on the ground of the amusement park ride 100. For example, one or more animations may include an animated figure that appears to be crawling on the ground via the rails 103. In such embodiments, the reaction controlled system 102 may cause the animated figure to push upward (e.g., pop upward), for example, when the guest is near the animated figure. Additionally or alternatively to the depicted linear rails 103 that are positioned horizontally and vertically to provide movement in the x-axis and y-axis of the linear system, the systems and methods described herein may utilize curved or non-linear rails 103 (e.g., sharp and/or smooth curved line shaped rails 103), and that provide movement in a z-axis of the linear axes system. By way of example, the rails 103 may be routed along the walls of a tunnel portion of the amusement park ride 100, such that rails 103 curve from the one end of the tunnel to the other end, in an arch shape.

As shown, the trolleys 104 of the trolley system may be connected to the rails 103 and cables 105, which connect to animated FIG. 106. Thus, the reaction controlled system 102 may maneuver the animated FIG. 106 horizontally and/or vertically by causing the trolleys 104, which are representative of a type of vehicle, to move along the rails 103, which are representative of any manner of track or path. The rails 103 and the trolleys 104 may simultaneously provide independent or dependent movements for animations to multiple animated FIG. 106. Moreover, the architecture of the multiple rails 103 across the particular area of the amusement park ride 100 may alleviate heavy lifting otherwise associated with lifting each individual animated FIG. 106 using a harness mounted to the ceiling.

The reaction controlled system 102 may also pull up the cables 105 to shorten the length of the cables 105 or drop down the cables 105 to increase the length of the cables 105 that extends from the trolleys 104. In this manner, the animated FIG. 106 connected to the cables 105 may move upward or downward in the z-axis. In the depicted embodiment, a first animated FIG. 106*a* is a witch, a second animated FIG. 106*b* is a skeleton, and a third animated FIG. 106*c* is a bat. These animated FIG. 106 are connected to the cables 105. Thus, the reaction controlled system 102 may move the animated FIG. 106 in the x-axis and/or in the y-axis via the trolley system, and move the animated FIG. 106 vertically in the z-axis via the cables 105.

In some embodiments, the reaction controlled system 102 may cause the cables 105 to move back and forth, lean back and forth, and/or rotate. Additionally or alternatively to the rails 103, trolleys 104, and/or the cables 105 providing the range of movements, reaction controlled elements 108 on the animated FIG. 106 may provide the range of movements. As previously mentioned, the reaction controlled elements 108 may include one or more propellers (e.g., motor driven propellers, quadcopter propellers, clockwise and/or a counter clockwise propellers), UAV's (e.g., drones), electric ducted fans, pneumatic devices, and/or gyroscope devices. In particular, the animated FIG. 106 may include the reaction controlled elements 108 on areas or features to be animated, such as extremities of the animated FIG. 106. For example, the third animated FIG. 106*c* includes reaction control elements 108 on its wings. The reaction control elements 108 of the third animated FIG. 106*c* may be used to assist or motivate the associated trolley 104 and/or to move the wings relative to other features of the third animated FIG. 106*c* while being supported or maintained within a certain area by the associated cable 105. In some embodiments, the cable 105 may be rigid (e.g., a post) that maintains a position relative to the rail 103 and facilitates relative motion of the reaction controlled elements 108.

As shown, a fourth animated FIG. 106*d* and a fifth animated FIG. 106*e* both include the reaction controlled elements 108 on their bodies, which may be used to manipulate the fourth animated FIG. 106*d* and the fifth animated FIG. 106*e* without employing a cable 105. The fourth animated FIG. 106*d* is a bat that includes the reaction controlled elements 108 on its wings while the fifth animated FIG. 106*e* is also a bat that includes the reaction controlled elements 108 on its back via a rod 107. The reaction controlled elements 108 on the wings of the fourth animated FIG. 106*d* may animate the wings, such as to cause the wings to move up and down (e.g., flying animation), rotate, and so forth, without the assistance of any cables 105. Similarly, the reaction controlled elements 108 on the back of the fifth animated FIG. 106*e* may cause the body of the fifth animated FIG. 106*e* to move up and down, rotate, and so forth, without the assistance of any cables 105. In some embodiments, such as the fifth animated FIG. 106*e*, the reaction controlled elements 108 may be connected to the rod 107 or another assembly that connects to the body of the animated FIG. 106. In this manner, the reaction controlled elements 108 on the animated FIG. 106 may provide controlled movements for animations without heavy assemblies. Additionally, the reaction controlled elements 108 on the animated FIG. 106 may be easily concealable and/or not perceivable by the guest while on the amusement park ride 100.

In some embodiments, the animated FIG. 106 may include the reaction controlled elements 108, such as on their extremities (e.g., the limbs, the head, or other character features), as well as be connected to the rails 103, trolleys 104, and/or the cables 105. Here, the first animated FIG. 106*a*, the second animated FIG. 106*b*, and the third animated FIG. 106*c* also include the reaction controlled elements 108 on their extremities or features. By way of example, the first animated FIG. 106*a* (e.g., the witch) includes the reaction controlled elements 108 on the limbs, such as hands, knees, and feet, to facilitate animations using these features. Connections between such features (e.g., hands and feet) and other aspects of the first animated FIG. 106*a* may include hinged or flexible connections to allow for relative movement. Mass of the various features of the animated FIG. 106 may work with gravity or rigid connections that may be employed to facilitate relative movement of component parts. By way of example, the reaction controlled elements 108 on the first animated FIG. 106*a* may move the hands (which are coupled via a hinge to a main body of the animated FIG. 106*a*) up and away from the illustrated broom stick and subsequently rotate the hands to facilitate a waving animation. The rails 103, trolleys 104, and/or the cables 105 may provide movement within the x-y-z axes to move the overall animated FIG. 106 horizontally and/or vertically and up and/or down within the particular area of the amusement park ride 100. Additionally or alternatively, the reaction controlled elements 108 on the animated FIG. 106 may provide movement within the x-y-z axes, as well as more detailed movements for animations involving features (e.g., components) of the animated FIG.

106, without using the rails 103, trolleys 104, and/or the cables 105 for animating these features (e.g., no cables connected to limbs).

The reaction controlled system 102 may provide the animations when the guest is on the amusement park ride 100 (e.g., the guest perceives the animated FIG. 106 to be flying while on a ride cart). As will be discussed with respect to FIG. 5, the reaction controlled system 102 may determine that the guest is presently on the amusement park ride 100 based on sensor data. As shown, a ride cart 112 of the amusement park ride 100 may include one or more radio frequency identification (RFID) tags 118. As the ride cart 112 on a ride path 113 moves along ride tracks 116, an electronic reader 119 on the ride track 116 may read the RFID tags 118, indicating presence of the ride cart 112. Based on the ride cart 112 being present and moving along the ride tracks 116, the reaction controlled system 102 may determine that a guest is present within a threshold distance of the animated FIG. 106 that may be animated to react to and/or interact with the guest. Additionally or alternatively, a weight sensor 120 positioned on the ride track 116 may detect a weight above a threshold weight when the ride cart 112 moves over the weight sensor 120, indicating presence of the ride cart 112 and/or the guest.

After determining that the ride cart 112 is present and a guest is likely present, additional park sensors, such as a camera 114 and/or a guest-wearable RFID tag 118, may trigger the additional park sensors to send data to the reaction controlled system 102 to assist in detecting the guest. For example, the reaction controlled system 102 may also perform an image analysis to determine that the guest is in the ride cart 112 and/or facing the animated FIG. 106. Additionally or alternatively to the camera 114, the reaction controlled system 102 may analyze data associated with the RFID tag 118 to determine presence of the guest. In some embodiments, the reaction controlled system 102 may determine the presence of the guest using the camera 114 and/or the RFID tag 118 rather than initially determining the presence of the guest, for example, based on the weight of the ride cart 112.

Figure 2:
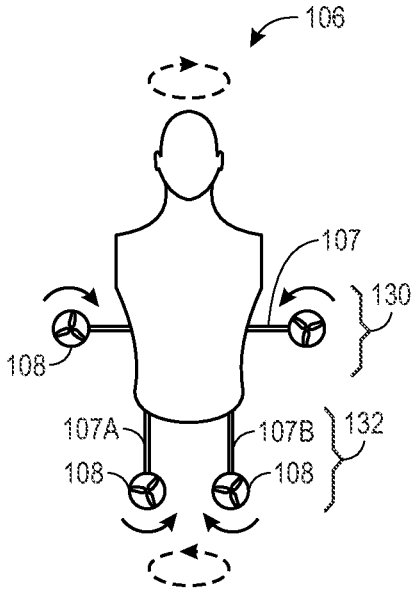
FIG. 2 is a schematic diagram of an animated figure connected to reaction controlled elements of the reaction controlled system, in accordance with an embodiment of the present disclosure.

The reaction controlled system 102 may animate the animated FIG. 106 upon determining that the guest is present. Specifically, the reaction controlled system 102 may cause the animated FIG. 106 to move in one or more directions to facilitate providing the animations, such as to fly, float, dance, and so forth. To illustrate, FIG. 2 is a schematic diagram of an animated FIG. 106 connected to reaction controlled elements 108. Although the depicted embodiment shows and describes multiple reaction controlled elements 108 on the animated FIG. 106, the systems and methods described herein may include one or more reaction controlled elements 108 on the animated FIG. 106 to provide the animations.

As shown, the reaction controlled elements 108 are connected to the rods 107, which are connected to the animated FIG. 106. In the depicted embodiments, a first reaction controlled assembly 130 includes a rod 107 with reaction controlled elements 108 on each end of the rod 107. The first reaction controlled assembly 130 is connected (e.g., mounted) to the center of an abdomen of the animated FIG. 106. This placement allows the weight of the animated FIG. 106 to be distributed evenly while also allowing movement of the entire body of the animated FIG. 106 with one assembly for animations. To provide the movement, the reaction controlled elements 108 of the first reaction controlled assembly 130 may rotate in opposite directions (e.g., counter-rotating installation), such that reaction controlled element 108 on one end of the rod 107 drives in a clockwise direction while the reaction controlled element 108 on the other end of the rod 107 drives in a counter-clockwise directions (as depicted by the solid line arrows by the first reaction controlled assembly 130). The reaction controlled elements 108 rotating in the opposite directions may generate a thrust in a particular direction, causing the animated FIG. 106 to move in an opposite direction to the thrust. By way of example, when the animated FIG. 106 is horizontally positioned, such that the body of the animated FIG. 106 is parallel to the ground, the thrust may cause the animated FIG. 106 to float for a floating animation.

In some embodiments, the animated FIG. 106 may include additional reaction controlled assemblies, such as second reaction controlled assembly 132. Here, the second reaction controlled assembly 132 includes a first rod 107A and a second rod 107B, with reaction controlled elements 108 connected on each end of the first rod 107A and the second rod 107B. The second reaction controlled assembly 132 is connected to the lower portion of the animated FIG. 106, such as the lower abdomen or legs (not shown). Similar to the reaction controlled elements 108 of the first reaction controlled assembly 130, the reaction controlled elements 108 of the second reaction controlled assembly 132 may drive in opposite directions and generate a thrust (as depicted by the solid line arrows by the second reaction controlled assembly 132), causing the animated FIG. 106 to move in a direction opposite to the thrust. The placement of the second reaction controlled assembly 132 may also allow distributing the weight of the animated FIG. 106, while also moving at least the lower portion of the animated FIG. 106 for animations.

In the depicted embodiment, the driving or rotation direction of the reaction controlled elements 108 to generate the thrust, cause the animated FIG. 106 to rotate clockwise and/or counter-clockwise in a rotational axis (as shown by the dashed line arrows). Depending on the orientation of the animated FIG. 106, the rotation may cause the animated FIG. 106 to turn (e.g., rotate) to the left or to the right. In general, the thrust generated by one or more of the reaction controlled elements 108 of the first reaction controlled assembly 130 and/or the second reaction controlled assemble 132, may facilitate various animations for the animated FIG. 106 involving different movements, such as rotating, moving towards or away with respect to the guest, floating, leaning towards or away from the guest, and so forth. By way of example, the reaction controlled elements 108 rotating in the clockwise direction may provide a forward thrust while the reaction controlled elements 108 rotating the counter-clockwise direction may provide a backwards thrust, or vice versa (e.g., based on whether the reaction controlled elements 108 are right-hand or left-hand propellers). Moreover, the reaction controlled elements 108 may each drive independently to provide a greater control of movements in the multiple axes via the multiple reaction controlled elements 108.

Figure 3:
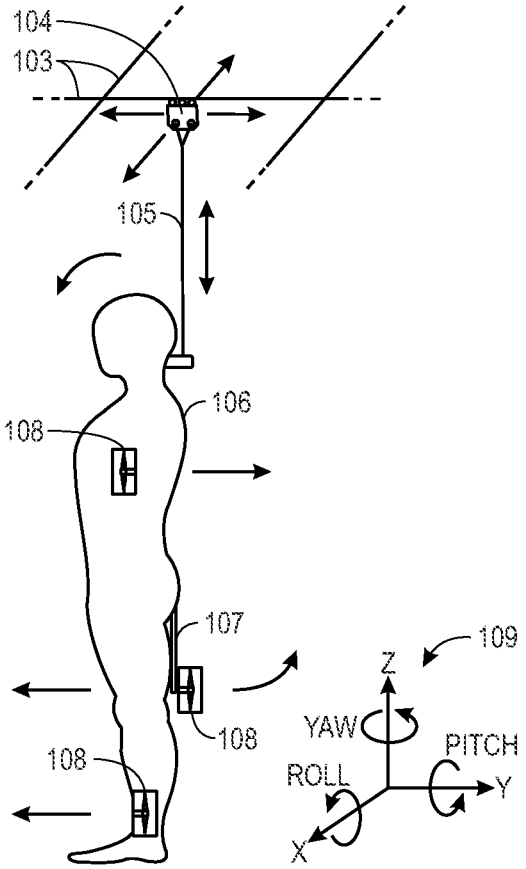
FIG. 3 is a schematic diagram of the animated figure connected to the reaction controlled elements and to a trolley system, in accordance with an embodiment of the present disclosure.

As previously discussed, in some embodiments, the animated FIG. 106 may be connected to a cable 105 to provide animations. The cable 105 may provide vertical animations, such as causing the animated FIG. 106 to be at different heights with respect to the trolley 104. In particular, the reaction controlled system 102 may change the length of the cable 105 to shorten the height or increase the height. The reaction controlled system 102 may use a counterweight, a custom tensioning system, a buoyancy, and/or a winch (e.g., retract or pull in) to change the length. When used in conjunction with the reaction controlled element 108, the cable 105 may also cause the animated FIG. 106 to lean forward or backwards. To illustrate, FIG. 3 depicts the animated FIG. 106 connected the reaction controlled elements 108 and connected to the trolley system (e.g., the rails 103 and the trolley 104). As shown, the cable 105 connected to the animated FIG. 106 may be connected to the trolley 104 that moves along the rails 103. Although the following descriptions describe the animated FIG. 106 as connected to one cable 105, the systems and the methods describe herein, may use one or more cables 105 to move the animated FIG. 106. Additionally or alternatively, the cable 105 may be placed on the animated FIG. 106 elsewhere (e.g., not between the shoulder blades) based on one or more factors, such as the animations to be provided by the animated FIG. 106 and/or the weight distribution of the animated FIG. 106. Moreover, although the following descriptions describe the animated FIG. 106 as including both the reaction controlled elements 108 (e.g., on the body) and as connected to a reaction controlled element 108 via the rod 107, which illustrates a particular embodiment, the animated FIG. 106 may include either the animated FIG. 106 integrated with one or more reaction controlled elements 108 or one or more reaction controlled elements 108 connected to the animated FIG. 106 via one or more rods 107, to provide the animations.

As previously mentioned, the cable 105 may provide vertical animations that cause the animated FIG. 106 to move up or down (as shown by the double headed arrow) by changing the length of the cable 105 to shorten the height or increase the height (e.g., via the winch). Each of the reaction controlled elements 108 may also provide animations. In particular, the reaction controlled elements 108 may independently and individually rotate, accelerating a mass of air or gas that generates a thrust to move the animated FIG. 106. The reaction controlled elements 108 may convert rotary motion from a power source into a stream of air or gas that lifts or pushes the reaction controlled elements 108 forward or backwards, and thus moves the animated FIG. 106. This may cause each of the reaction controlled elements 108 to move along multiple axes of a linear axes system 109 associated with a yaw, a pitch, and/or a roll, to provide the animations at the reaction controlled elements 108. That is, the reaction controlled elements 108 may each provide roll, pitch, and/or yaw movement, as well as surge, heave, and/or sway motions. By way of example, and as will be discussed with respect to FIG. 4, the reaction controlled elements 108 may provide such movements at their locations on the animated FIG. 106, such as at individual joints. In some embodiments, the individual reaction controlled elements 108 may work together to move multiple joints, such as to move a limb via the multiple reaction controlled elements 108 on the joints. In general, the yaw movement may refer to rotation of the animated FIG. 106 and/or the reaction controlled elements 108 along a vertical axis of the linear axes system 109, such as the z-axis. The pitch movement may refer to the rotation of the animated FIG. 106 and/or reaction controlled elements 108 along a side-to-side axis of the linear axes system 109, such as the y-axis (e.g., in the left to right direction). The roll movement may refer to rotation of the animated FIG. 106 and/or the reaction controlled elements 108 along a front-to-back axis of the linear axes system 109, such as the x-axis (e.g., in the forward and backward direction).

The yaw motion may allow rotating the animated FIG. 106 from left to right or side-to-side, similar to turning your body or head. That is, the yaw motion may move the animated FIG. 106 in a clockwise or counter-clockwise rotation while staying leveled with the ground. This may allow adjusting the orientation of the animated FIG. 106, for example, in a direction facing the guest for animations. The pitch motion may cause the animated FIG. 106 to move and/or lean forward or backward. The roll motion may cause the animated FIG. 106 to lean in either the left or the right direction or from side-to-side, making the animated FIG. 106 "roll" to either direction (move to one side depending on the lean). Thus, the reaction controlled elements 108 may provide the yaw, the pitch, and/or the roll motions, to facilitate moving the animated FIG. 106 in different directions for animations.

The reaction controlled elements 108 may independently generate the thrust in a particular direction (as shown by the straight solid line arrows), causing the animated FIG. 106 at the particular reaction controlled elements 108 to pitch in the opposite direction. For example, and as depicted, the reaction controlled elements 108 integrated into the animated FIG. 106 (e.g., ankle) may rotate and generate a thrust towards the front of the animated FIG. 106. This thrust direction causes the animated FIG. 106 to move and/or pitch forward. Similarly, the reaction controlled element 108 connected to the rod 107 and the animated FIG. 106, may rotate and cause a thrust towards the front of the animated FIG. 106. This thrust direction causes the animated FIG. 106 to pitch forward (as shown by the curved solid line arrows). Thus, generating the thrust may allow the animated FIG. 106 to move (e.g., forward or backward) and/or pitch the animated FIG. 106 in the opposite direction. That is, the reaction controlled elements 108 integrated into the animated FIG. 106 (e.g., on the abdomen and ankle) and/or the reaction controlled element 108 connected to the animated FIG. 106 (e.g., via the rod 107) may provide movement within the linear axes system 109 and movement of joints, limbs, and/or body of the animated FIG. 106 to provide animations.

In some embodiments, the reaction controlled element 108 integrated into the animated FIG. 106 (e.g., on the abdomen and ankle) or connected to the animated FIG. 106 (e.g., via the rod 107) may also provide a pendulum effect. In particular, as the reaction controlled elements 108 generate the thrust that causes the animated FIG. 106 to move in the opposite direction, the cable 105 may move with the animated FIG. 106. As the animated FIG. 106 continues to move and/or if the rotation of the reaction controlled elements 108 periodically starts, stops, accelerates, and/or deaccelerates, the weight of the animated FIG. 106 connected to the cable 105 may cause the animated FIG. 106 to swing freely. That is, the animated FIG. 106 may function as a pendulum, and when the reaction controlled elements 108 moves the animated FIG. 106 from an equilibrium position (e.g., a resting position), a restoring force due to gravity may accelerate it back and forth towards the equilibrium position. This acceleration may cause the animated FIG. 106 to move further outward or inward with respect to the equilibrium position. Thus, the pendulum effect caused by the reaction controlled elements 108 when used in conjunction with the cable 105, may allow the animated FIG. 106 to travel a longer distance for animations than without the pendulum effect.

In some embodiments, the reaction controlled elements 108 may also facilitate moving the animated FIG. 106 along the trolley system. That is, the thrust may cause the trolley 104 to move along the rails 103. By way of example, the trolley system may move the animated FIG. 106 towards the guest and the reaction controlled elements 108 may generate a thrust to cause the animated FIG. 106 to turn (e.g., left or right) around and move away from the guest. The reaction controlled elements 108 may push the animated FIG. 106 along the trolley system.

Figure 4:
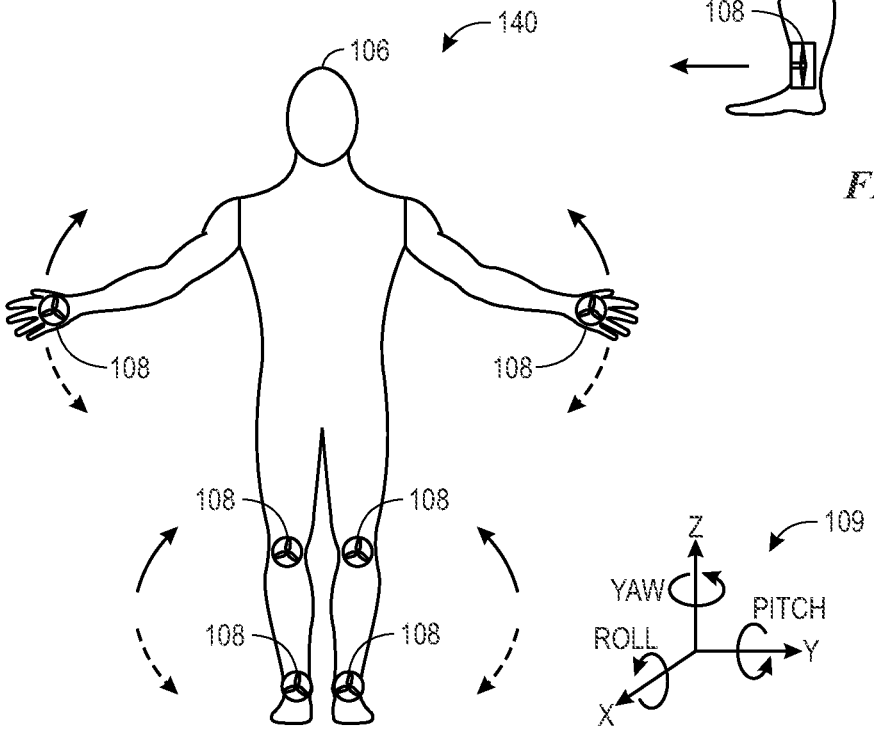
FIG. 4 is a schematic diagram of the animated figure including the reaction controlled elements, in accordance with an embodiment of the present disclosure.

FIG. 4 depicts the animated FIG. 106 with the reaction controlled elements 108, which provide movements for the animations and positioning within the linear axes system 109. As previously discussed, in some embodiments, the animated FIG. 106 may include the reaction controlled elements 108 on the animated FIG. 106, such as on areas or features to be animated. Although the depicted embodiment includes the animated FIG. 106 integrated with six reaction controlled elements 108, the systems and methods described herein may include the animated FIG. 106 integrated with multiple reaction controlled elements 108 (e.g., 2, 10, 100, and so forth) and/or that vary in size (e.g., smaller reaction controlled elements 108 for fingers and larger for hands of the animated FIG. 106). Additionally, although the depicted embodiment includes reaction controlled elements 108 on hands, knees, and feet of the animated FIG. 106, which represents a particular embodiment, the systems and methods described herein may include reaction controlled elements 108 on any area of the animated FIG. 106 to be animated. For example, the animated FIG. 106 my include reaction controlled elements 108 on the fingers, neck, leg, elbows, other body joints, accessories coupled to the animated FIG. 106, portions of the accessories, and so forth. By way of example, if the animation includes moving certain parts of the animated FIG. 106, such as extremities, the reaction controlled elements 108 may be part of or placed on the extremities. Here, the animated FIG. 106 includes the reaction controlled elements 108 on each of the hands, the knees, and the feet of the animated FIG. 106. As such, the reaction controlled elements 108 on the hands may provide movements for the hands as the arms hinge about the shoulders of the animated FIG. 106. Similarly, the reaction controlled elements 108 on the knees and feet may provide movements for the legs as each of the legs hinge about the torso of the animated FIG. 106. The reaction controlled elements 108 may operate independently to generate independent animations. That is, the reaction controlled elements 108 on the animated FIG. 106 may generate a thrust in different directions and/or at different speeds to move the limbs and joints independently for the animation. By way of example, the reaction controlled elements 108 on the left knee and left foot of the animated FIG. 106 may cause the left leg to move downwards in the z-axis by generating a thrust in a particular direction while the reaction controlled elements 108 on the right knee and right foot of the animated FIG. 106 may cause the right leg to move upwards in the z-axis by generating the thrust in the opposite direction. Moreover, the reaction controlled elements 108 on the knee may provide movements for the knees, such as for bending, as the knees hinge on the thighs. Further, the reaction controlled elements 108 on the feet may also provide movements for the feet, such as bending upward and/or downward, as the feet hinge on the ankles.

Specifically, the reaction controlled elements 108 on each of the hands, knees, and feet may rotate to generate a thrust in a particular direction, causing the hand to move in the opposite direction. By way of example, the reaction controlled elements 108 may create a thrust that moves air downwards (e.g., by rotating its blades clockwise), causing the hands, knees, and feet to move upward (as depicted the solid line arrows) and a hinging action to occur at the shoulder, the torso, and the ankles of the animated FIG. 106. Similarly, the reaction controlled elements 108 may create a thrust that moves air upwards (e.g., by rotating its blades counter-clockwise), causing the hands, knees, and feet to move downward (as depicted the dashed line arrows). In some embodiments, it should be noted that the animated FIG. 106 may be buoyant in the environment (e.g., air or water) and require assistance in addition to gravity to move downward at an appropriate rate. The thrust may also position the animated FIG. 106 within the linear axes system 109. In particular, enabling the reaction controlled elements 108 to generate the thrust in a particular direction may move the animated FIG. 106 in the opposite direction. By way of example, one or more reaction controlled elements 108 on the limbs (e.g., the hands, feet, head, and so forth) and/or on the back (not shown) of the animated FIG. 106, may rotate in a particular direction and generate a downwards thrust to move the animated FIG. 106 upward. Moving the body of animated FIG. 106 upward may position the animated FIG. 106 within the z-axis. Similarly, one or more reaction controlled elements 108 on the limbs and/or the body of the animated FIG. 106 may generate a thrust to position the animated FIG. 106 within the x and y-axes.

Figure 5:
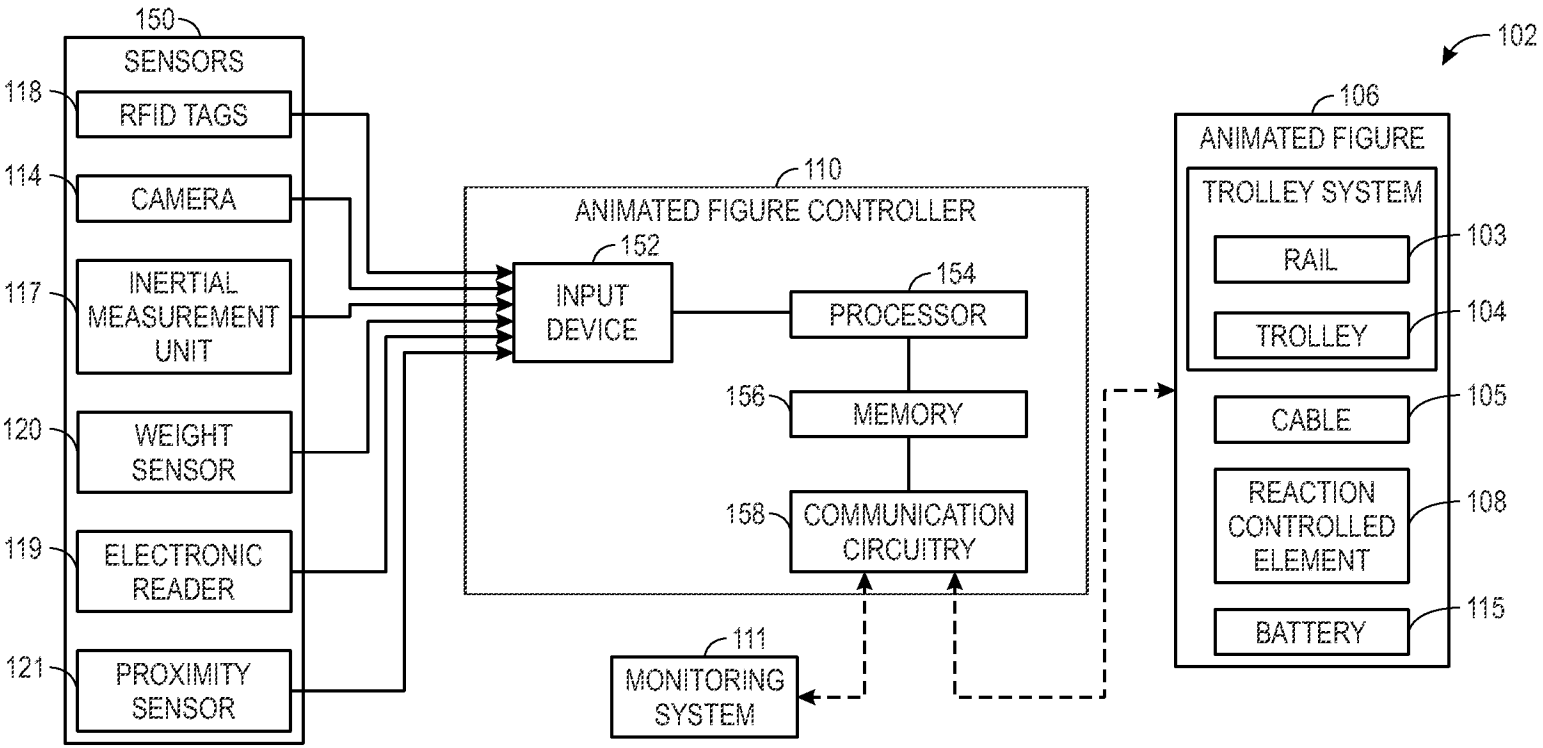
FIG. 5 is a block diagram of a reaction controlled system for providing reaction controlled animations, in accordance with an embodiment of the present disclosure.

FIG. 5 depicts the reaction controlled system 102 for providing movements and/or motions for animations. As shown, the reaction controlled system 102 includes sensors 150, an animated figure controller 110, and an animated FIG. 106. Although the animated figure controller 110 and the animated FIG. 106 are described and depicted as separate components, the system and methods described herein may also include the animated FIG. 106 and/or the reaction controlled elements 108 integrated with the animated figure controller 110 (e.g., single device or component). By way of example, the animated figure controller 110 integrated with one or more reaction controlled elements 108 may provide on-board control signals to control the reaction controlled elements 108. The control signals may control the initializing, shutdown, speed of rotation, and so forth of the propelling components (e.g., propellers) of the reaction controlled elements 108 and/or other components of the animated FIG. 106 (e.g., actuators). In addition to controlling the animated FIG. 106, the reaction controlled system 102 may also control other show scene features, such as a prop, a lighting effect, and/or a sound effect. In some embodiments, the reaction controlled system 102 may be directly or communicatively coupled to a show scene system controlling these show scene features. As such, the reaction controlled system 102 and/or the show scene system may synchronize the animated FIG. 106 and other show scene features to provide a particular animation or show effect. For example, the animated figure controller 110 integrated with the reaction controlled element 108 and/or animated FIG. 106 may provide on-board control signals to control the animated FIG. 106, the prop, the lighting effect, and/or the sound effect, in a synchronized manner.

It should be understood that the illustrated system is merely intended to be exemplary, and that certain features and components may be omitted and various other features and components may be added to facilitate performance, in accordance with the disclosed embodiments.

In an amusement park setting, the animated figure controller 110 may control the animated FIG. 106. The amusement park may include attractions throughout the amusement park, such as rides, virtual game rooms, picnic areas, restaurants, and so forth, that may include one or more animated FIG. 106. As will be discussed in detail with respect to FIG. 6, the animated figure controller 110 may control the animated FIG. 106, for example, to provide animations and/or to interact with a guest at the amusement park. By way of example, the animated figure controller 110 may control the height of the animated FIG. 106 with respect to the guest and/or movement of individual limbs of the animated FIG. 106. In some embodiments, guest presence on or near the animated FIG. 106, such as on the amusement park ride 100, may trigger the animated figure controller 110 to control the movements of the animated FIG. 106. The reaction controlled system 102 may detect the guest using one or more of the sensors 150.

The sensors 150 may include one or more radio frequency identification (RFID) tags 118, one or more cameras 114, one or more inertial measurement units 117, one or more weight sensors 120, one or more electronic readers 119, and/or one or more proximity sensors 121. The sensors 150 may be placed or positioned in areas where guest presence is expected, such as on the ride cart 112 or the ride track 116 of the amusement park ride 100. The RFID tags 118 may communicate with the electronic readers 119 to indicate the presence of the guest. In particular, the RFID tags 118 may be incorporated on the amusement park ride 100, such as on the ride track 116 or the ride cart 112 of the amusement park ride 100 (e.g., inside, on the side, or on the entryway of the ride cart 112). Thus, the electronic readers 119 may be placed in a manner that allows scanning of the RFID tag 118. By way of example, an electronic reader 119 may be placed on the ride track 116 so that the electronic reader 119 scans the RFID tag 118 on the ride cart 112 as the ride cart 112 passes over the electronic reader 119, indicating that the guest is on the ride. In some embodiments, the RFID tags 118 may include guest-wearable RFID tags 118 (e.g., wristband with an RFID tag 118). Thus, input data from the electronic reader 119 may indicate that the guest is present upon scanning the guest-wearable RFID tag 118. Subsequently, the animated figure controller 110 may animate the animated FIG. 106, such as to cause the animated FIG. 106 to move, rotate, lean, and/or accelerate (e.g., to provide a flying animation).

In additional embodiments, cameras 114 may be placed or positioned in areas based on where guest presence is expected, such as to view the ride cart 112 on the amusement park ride 100. The cameras 114 may determine the presence of the guest based on images or video captured by the cameras 114. Specifically, the cameras 114 may perform facial recognition and/or body recognition to determine the presence of the guest. In some embodiments, the cameras 114 may instead provide the images and/or video as input data to the animated figure controller 110, which may subsequently perform the facial recognition and/or body recognition.

Additionally or alternatively, the weight sensors 120 may indicate presence of the guest. The weight sensors 120 may be mounted on the ride tracks 116 and may indicate presence of the ride cart 112 on the ride tracks 116 based on a predetermined weight. Similarly, the proximity sensors 121 may be placed or positioned proximate to areas where guest presence is expected. The proximity sensors 121 may detect a presence of nearby objects without physical contact by using electromagnetic fields, light, and/or sound. The proximity sensors 121 may emit an electromagnetic field or a beam of electromagnetic radiation (e.g., infrared) and look for changes in the field or return signal. To accurately detect the presence of the nearby object as a guest, the proximity sensors 121 may be positioned near a loading point for the ride cart 112 and/or on a ride cart seat. In general, the RFID tags 118 and/or the cameras 114 may be used alone or in conjunction with other sensors 150 (e.g., weight sensors 120 and/or proximity sensors 121) to detect the presence of the guest and/or to identify the guest.

The inertial measurement units 117 include devices that measure force, angular rate, and/or orientation of the animated FIG. 106, such as accelerometers, gyroscopes, and/or magnetometers. The inertial measurement units 117 may provide these measurements to the reaction controlled system 102, which may use them to determine a degree of movement for the animated FIG. 106 within the linear axes system 109. That is, based on the measured force, angular rate, and/or orientation of the animated FIG. 106 and an animation to implement for the animated FIG. 106, the reaction controlled system 102 may determine which reaction controlled elements 108 to initialize, the amount of thrust from each of the initialized reaction controlled elements 108, rotation speed of a propelling assembly (e.g., propellers, UAV's, electric ducted fans, pneumatic devices, and/or gyroscope devices) of the reaction controlled elements 108 to generate a faster or a slower thrust, and so forth, with respect to the initial force, angular rate, and/or orientation of the animated FIG. 106. Moreover, the measurement from the inertial measurement units 117 may allow the reaction controlled system 102 to compensate for inertial loads. That is, the animated FIG. 106 may have an inertial load since the animated FIG. 106 connected to the cable 105 has a mass and the cable 105 has a mass. The inertial load may refer to a resistance to change, such as velocity, of the animated FIG. 106. By way of example, a cable 105 connected to a large mass, such as the animated FIG. 106, and having a large radius, such as a long cable length, may correspond to a high inertia. Once the cable 105 starts moving with the animated FIG. 106, stopping the inertial load may be difficult. The inertial measurement units 117 may measure the inertia, send the measurements to the reaction controlled system 102, and the reaction controlled system 102 may control the reaction controlled elements 108 accordingly. That is, the reaction controlled system 102 may cause the reaction controlled elements 108 to generate a faster and stronger thrust to counter a heavy inertial load. By way of example, the reaction controlled system 102 may enable many reaction controlled elements 108 to counter a heavy animated character 106.

The reaction controlled system 102 also includes a monitoring system 111. The monitoring system 111 may be an administrative system that monitors the sensors 150 and/or the animated FIG. 106. For example, the monitoring system 111 may monitor control signals to change the animations provided by the animated FIG. 106 that are sent from the animated figure controller 110 in response to the presence of the guest. In particular, the monitoring system 111 may ensure that the sensors 150 and/or the animated FIG. 106 function as expected and/or provide the animations as expected. For example, the monitoring system 111 may ensure that the animated FIG. 106 moves in the expected direction using the trolley 104. In some embodiments, the monitoring system 111 may also track wait times or queues for the rides to maintain an expected throughput.

Additionally, if the animated figure controller 110 is not functioning as expected (e.g., transmitting erroneous control signals), the monitoring system 111 may control or reconfigure the animated figure controller 110. That is, the monitoring system 111 may reset the animation algorithms of the animated figure controller 110 (e.g., algorithms that initialize the reaction controlled elements 108) and/or override or reset animations provided by the animated figure controller 110. In this manner, the monitoring system 111 may reset or recalibrate the animated figure controller 110, the sensors 150, and/or the animated FIG. 106. In certain embodiments, the monitoring system 111 and the animated figure controller 110 may be implemented as a single controller.

The animated figure controller 110 may enable communication circuitry 158 to interface with various electronic devices, such as the monitoring system 111 and/or the animated FIG. 106. The monitoring system 111 may communicate with the animated figure controller 110 to receive and/or send information (as depicted by double-headed arrow) to ensure that the animated FIG. 106 is operating as expected. Additionally, or alternatively, the animated figure controller 110 may enable the communication circuitry 158 to interface with components of the animated FIG. 106 to receive and/or send information (as depicted by double-headed arrow). For example, the communication circuitry 158 may allow the animated figure controller 110 to communicatively couple to a network, such as a personal area network (PAN), a local area network (LAN), and/or a wide area network (WAN). Accordingly, in some embodiments, the animated figure controller 110 may process data from an input device 152, determine presence of the guest, determine animations for the animated FIG. 106, and communicate movements to be implemented for animations to the animated FIG. 106 via the communication circuitry 158. For example, after processing sensor data from the input device 152, the processor 154 may determine a control signal that enables the communication circuitry 158 to wirelessly transmit control data to the animated FIG. 106 to enable activation of the reaction controlled elements 108 and/or the trolley system to provide the movements. In other embodiments, the communication circuitry 158 may be connected via a wired connection to the animated FIG. 106.

The processor 154 may include one or more processing devices that receive input signals from the input device 152 relating to the presence of the guest, which may then be used to determine a movement or a motion for an animation for the animated FIG. 106, using techniques described herein. A memory 156 may include one or more tangible, non-transitory, machine-readable media. By way of example, such machine-readable media can include RAM, ROM, EPROM, EEPROM, or optical disk storage, magnetic disk storage or other magnetic storage devices, or any other medium which can be used to carry or store desired algorithms (e.g., program code) in the form of machine-executable instructions or data structures and which can be accessed by the processor 154 or by other processor-based devices. In particular, the processor 154 may include a processing core to execute machine-executable instruction algorithms stored in the memory 156. The processor 154 may also include processor-side interfaces for software applications running on the processing core to interact with hardware components on the amusement park ride 100 associated with the processor 154, such as the animated FIG. 106, and/or other show scene features (e.g., the sound effect, the lighting effect, the prop, etc.). By way of example, the processor 154 may enable one or more actuators (e.g., for eyes, lip, head, neck, and other appendages), audio devices, video devices, illumination devices, and so forth, of the animated FIG. 106 to provide an animation. That is, the processor 154 may provide a facial expression via eyes and lips actuators, produce a glowing effect via the illumination device, play audio via the audio device, display video via the video devices, and so forth. These features may allow animations that make the animated FIG. 106 appear to be speaking with guests on the amusement park ride 100. In some embodiments, the animated FIG. 106 may also include atmospheric effect devices to generate a fog effect, a wind effect, a precipitation effect (e.g., water), and so forth, from the animated FIG. 106.

By way of example in the amusement park setting, the stored algorithms may include, but are not limited to, algorithms to determine the guest presence based on sensor data from the sensors 150, determine animations for the animated FIG. 106 (e.g., stored in the memory 156), determine configuration of the reaction controlled elements 108 (e.g., which reaction controlled elements 108 to initialize, direction of blade rotation of the reaction controlled elements 108, speed of blade rotation, and so forth). In this manner, the animated figure controller 110 may determine the presence of the particular guest and control the animated FIG. 106 accordingly, for example, when the particular guest is within a predetermined range of the animated FIG. 106 and/or when the guest is determined to be oriented towards the animated FIG. 106. The animations may include animations for the animated FIG. 106 on the amusement park ride 100, but may also include interactions on the park grounds.

The animated FIG. 106 may include or be connected to rails 103, trolleys 104, cables 105, reaction controlled elements 108, and a battery 115. Although the following descriptions describe these components as separate and/or connected components representing a particular embodiment, the systems and methods described herein may also include an animated FIG. 106 without one or more of these components and/or a combination of one or more of these components. As previously discussed, the animated figure controller 110 may provide movements for animations to the animated FIG. 106. Upon receiving the movements associated with the animations, the animated figure controller 110 may initialize the rails 103, the trolleys 104, the cables 105, and/or the reaction controlled elements 108. In particular, the animated FIG. 106 may be connected to the cable 105, which connects to the trolley 104, which moves within the x-y axes via the rails 103, such as to move horizontally and/or vertically with respect to the rails 103. Specifically, the animated figure controller 110 may cause the trolley 104 to move along the paths provided by the rails 103. Additionally or alternatively, the animated figure controller 110 may actuate a winch on the trolley 104 and connected to the cable 105 to decrease the distance of the animated FIG. 106 from the trolley 104, such that the animated FIG. 106 is further from the ground. On the other hand, the animated figure controller 110 may let out the cable 105 to increase the distance of the animated FIG. 106 from trolley, such that the animated FIG. 106 is closer to the ground. Reeling the cable 105 in or spooling the cable 105 out via the winch may cause the animated FIG. 106 to be closer to the guest when the guest is on the ride cart 112. In some embodiments, such z-axis motion may be imparted by the rails 103 transitioning in height either dynamically (e.g., raising and lowering the rails) or based on inclines and declines of the rails 103.

Additionally or alternatively to initializing the trolley system, the animated figure controller 110 may initialize the reaction controlled elements 108 to provide the animations (e.g., cause the animated FIG. 106 and/or features of the animated FIG. 106 to move in various directions for the animations). As previously discussed, the animated figure controller 110 may independently control the reaction controlled elements 108 to provide the animations. In some embodiments, the reaction controlled elements 108 may be connected to the rods 107, which are mounted on the animated FIG. 106 to provide the animations. In additional embodiments, the reaction controlled elements 108 may be integrated or onboard (e.g., without the rods 107) the animated FIG. 106 to provide the animation. As previously discussed, the reaction controlled elements 108 (with or without the rods 107) may animate the animated FIG. 106. In particular, the reaction controlled elements 108 may rotate to generate the thrust, moving the animated FIG. 106 in a direction opposite to the thrust. The thrust may cause the animated figure to rotate, lean, orient, and so forth, the entire animated FIG. 106 and/or portions of the animated FIG. 106 (e.g., lower abdomen and/or limbs of the animated FIG. 106 connected to the reaction controlled elements 108). Additionally, the animated figure controller 110 may cause the reaction controlled elements 108 to rotate at a particular acceleration (e.g., speed up, slow down, stop, etc.). This may cause the animated FIG. 106 to move at different speeds (e.g., faster or slower) and/or to different degrees (e.g., further range of rotation or leaning). These movements, alone or in conjunction with one another, may provide a wide range of animation effects. By way of example, the reaction controlled elements 108 may cause the animated FIG. 106 to accelerate forward while also leaning forward, in a particular direction (e.g., towards the guest), creating a flying animation.

The battery 115 may include an onboard battery to power the animated FIG. 106 and its components, such as the reaction controlled elements 108 and/or the trolley 104. Additionally or alternatively, the animated figure controller 110 may provide power via an external power source and through the cable 105. In some embodiments, a charging station or pad may charge the battery 115 for the animated FIG. 106. The charging station may include a charging pad and the animated figure controller 110 may cause the animated FIG. 106 to return to the charging pad periodically, such as between animations, rides, shows, and/or after a predetermined time period. In additional or alternative embodiments, the battery 115 may be wirelessly charged. In particular, the wireless charging may use an inductive or magnetic field between coils to transfer power from the charging station to the battery 115. An alternating current may pass through an induction coil in the charging station, creating a fluctuating magnetic field that generates an electromotive force. The electromotive force generates an alternating current in an induction coil of the battery 115 or a device with the battery 115. The alternating current in the induction coil of the battery 115 or the device with the battery 115, may be converted to direct current with a rectifier to charge the battery 115.

Figure 6:
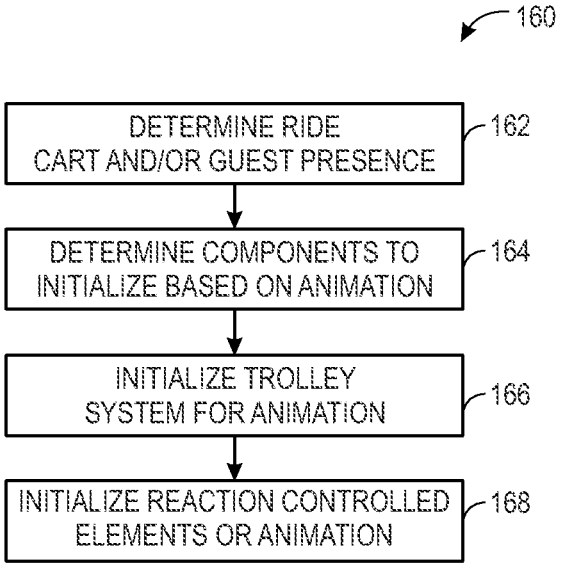
FIG. 6 is a process flow diagram for providing the reaction controlled animations, in accordance with an embodiment of the present disclosure.

FIG. 6 is a flow diagram of a process 160 for providing animations to the animated FIG. 106. While the process 160 is described using acts in a specific sequence, it should be understood that the described acts may be performed in different sequences than the sequence illustrated, and certain described acts may be skipped or not performed altogether. In general, at least some of the steps of the process 160 may be implemented at least in part by the reaction controlled system 102 of FIG. 5. Specifically, these steps may be implemented at least in part by the processor 154 of the reaction controlled system 102 that executes instructions stored in a tangible, non-transitory (meaning it is not a signal), computer-readable medium, such as the memory 156. In alternative or additional embodiments, at least some steps of the process 160 may be implemented by any other suitable components or control logic, and the like. Moreover, although the following descriptions describe an animated FIG. 106 with multiple reaction controlled elements 108 integrated into the animated FIG. 106 (e.g., as part of the joints, limbs, extremities, and/or other areas of the body) and connected to the animated FIG. 106 via the rods 107, which represents a particular embodiment, the animated FIG. 106 may instead include one or more reaction controlled elements 108 integrated into the animated FIG. 106 and/or one or more reaction controlled elements 108 connected to the animated FIG. 106 via one or more rods 107.

To provide reaction controlled animations by the reaction controlled system 102, the processor 154 may determine (process block 162) that the ride cart 112 and/or the guest is present, in a position of interest. In particular, the processor 154 may determine presence of the guest and position of the guest relative to the animated FIG. 106 based on sensor data from the sensors 150 received at the input device 152. That is, the input device 152 may receive sensor data that indicates that the ride cart 112 and/or the guest (e.g., in the ride cart 112) is within a predetermined threshold distance from the animated FIG. 106, such as within a viewing range from the animated FIG. 106. By way of example, the sensor data may indicate that the ride cart 112 is present based on a weight detected by the weight sensor 120 on the ride track 116, as previously discussed. Additionally or alternatively, the sensor data may indicate that the guest is present based on image data from the cameras 114 and/or detection of RFID tags 118 on a guest-wearable device on the guest. In this manner, the processor 154 may determine that the guest is in the viewing range for the animated FIG. 106, and thus, the processor 154 may provide animations to the animated FIG. 106. Otherwise, the animated FIG. 106 may remain in a default state, such as an inactive state (e.g., to preserve energy).

After determining that the guest is present, the processor 154 may determine (process block 164) components of the animated FIG. 106 to initialize based on an animation. That is, the processor 154 may determine one or more animations to provide based on one or more algorithms stored in the memory 156, as previously discussed. The animations may be based on the particular amusement park ride 100, the area (e.g., a specific show scene) within the particular amusement park ride 100, the time of day, data associated with the guest, the number of guests, events occurring at the amusement park, and so forth. Providing the animation may involve utilizing one or more components of the animated FIG. 106. By way of example, the animation may include a flying effect around the guest. The flying effect may involve moving the animated FIG. 106 in a clockwise direction, leaning the animated FIG. 106 forward and towards the guest, etc.

Moreover, determining the components to initialize may be based on the architecture of the animated FIG. 106, such as the integration or placement of the reaction controlled elements 108 on the animated FIG. 106 (e.g., on the limbs, back, and/or torso (e.g., abdomen and/or thorax)), the connections with the reaction controlled elements 108 (e.g., the reaction controlled elements 108 connected to rods 107), and/or connections to the trolley system. In some embodiments, and continuing with the flying animation example, the processor 154 may determine not to initialize the integrated reaction controlled elements 108 on the limbs of the animated FIG. 106 as they would not be needed to provide the flying animation for the animated FIG. 106. Instead, the processor 154 may determine initializing the trolley system and the reaction controlled elements 108 connected to the animated FIG. 106 via rods 107 to create a thrust that moves the entire body of the animated FIG. 106, causing it to provide the flying animation. In additional or alternative embodiments, such as an architecture of the animated FIG. 106 that is not connected to the trolley system and/or an animation that involves moving limbs of the animated FIG.

106 (e.g., hand moves up and down), the processor 154 may determine not to initialize the trolley system and/or the reaction controlled elements 108 connected to the rods 107. Instead, the processor 154 may determine initializing the reaction controlled elements 108 on the limbs of the animated FIG. 106. In such embodiments, the reaction controlled elements 108 may also provide the flying animation. By way of example, the individual reaction controlled elements 108 on the joints, limbs, and/or other areas of the body, may generate thrust in a direction to cause the animated FIG. 106 to float and/or fly in the opposite direction.

Further, in additional or alternative embodiments, the animated FIG. 106 may include or be coupled to a robotic arm assembly. The robotic arm assembly may also provide movement of the animated figure in the x-y-z axes. In particular, the robotic arm assembly may move upward, downward, inward, outward, rotate, and so forth, and move the coupled animated FIG. 106 correspondingly. For example, the robotic arm assembly may provide movements for a flying animation of the animated FIG. 106. Moreover, a single robotic arm assembly may move the animated FIG. 106 more efficiently than multiple reaction controlled elements 108, for example, when the animated FIG. 106 is heavy. In some embodiments, the robotic arm may position the animated FIG. 106 within the x-y-z axes while the reaction controlled elements 108 may move the extremities of the animated FIG. 106 to provide an animation effect.

In the embodiments that include the animated FIG. 106 connected to the trolley system (as indicated by the dashed line box) and the animation includes movements involving the trolley system, the processor 154 may initialize (process block 166) the trolley system for the animation. In particular, based on the animation, the processor 154 may cause the trolley 104 to move within the x-y-z axes of the show scene area of the amusement park ride 100 to correspondingly move the animated FIG. 106. In this manner, the animation may take advantage of the entire show scene as opposed to being mounted on a particular area of the show scene (e.g., the cable 105 connected to a pulley mounted or fixed to the ceiling of the show scene). Moreover, the processor 154 may determine the most efficient (e.g., fastest) path to an area of interest (e.g., near the guest) for the animated FIG. 106 within the show scene based on the animation. The processor 154 may then cause the trolley 104 to move along the horizontal and/or vertical rails 103 of the most efficient path. Upon reaching the area of interest, the processor 154 may move the animated FIG. 106 up and down by reeling in the cable or spooling out the cable 105 via the winch. In some embodiments, the animation may involve the animated FIG. 106 to provide additional movements, such as moving forward or backwards, leaning, rotating, and so forth. In such embodiments, the reaction controlled elements 108 on the animated FIG. 106 and/or connected to rails 103 that are connected to the animated FIG. 106, may be initialized. In some instances, the cables 105 may include electrical or signal conductors that are part of the cables 105 (e.g., electrical cables communicating electrical signals and/or power). That is, the cables 105 may provide a communication channel to the animated FIG. 106 for communicating control signals to the animated FIG. 106. For example, the cables 105 may communicate control signals (e.g., from the processor 154) to the reaction controlled elements 108 of the animated FIG. 106 to initialize them.

In embodiments that additionally or alternatively include the animated FIG. 106 with the reaction controlled elements 108 (e.g., on the body of the animated FIG. 106 and/or connected to the rails 103) and the animation includes movements using the reaction controlled elements 108, the processor 154 may initialize (process block 168) the reaction controlled elements 108 for the animation. As discussed with respect to FIGS. 2-4, the processor 154 may initialize the reaction controlled elements 108 to rotate, accelerating air in a particular direction to generate a thrust, and moving the animated FIG. 106 in the opposite direction. The processor 154 may also provide the roll, yaw, and/or pitch movements for the animated FIG. 106. In some embodiments, the processor 154 may adjust the speed of the rotation of the reaction controlled elements 108 to increase or decrease acceleration. By way of example, the processor may cause the reaction controlled elements 108 to rotate at a maximum or approximate maximum speed to provide a movement (e.g., lean forward towards the guest), and then scale back the speed upon fulfilling the movement (e.g., maintain leaning position and/or hover in the particular position). In some embodiments, the processor 154 may decouple the animated FIG. 106 from the cable 105 to provide the animation using the reaction controlled elements 108. By way of example, after reaching a particular or an approximately particular x-y position within the show scene, the processor 154 may cause the animated FIG. 106 to animate using the reaction controlled elements 108 without being connected to the cable 105, for example, to fly or float around the x-y position. Decoupling from the cable 105 may provide more flexibility for movement for animations. In this manner, the reaction controlled system 102 utilizes the rails 103, trolleys 104, cables 105, and/or the reaction controlled elements 108 to provide controlled movement and motions for an animation (e.g., flying and/or floating) for the animated FIG. 106 within the x-y-z axes without using heavy, bulky, and/or tangling assemblies.

While only certain features of the disclosure have been illustrated and described herein, many modifications and changes will occur to those skilled in the art. It is, therefore, to be understood that the appended claims are intended to cover all such modifications and changes as fall within the true spirit of the disclosure. It should be appreciated that any of the features illustrated or described with respect to the figures discussed above may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A reaction controlled system, comprising:

a track;

a trolley configured to travel along the track;

an animated figure coupled to the trolley;

at least one reaction control element coupled to a portion of the animated figure; and a controller communicatively coupled to the trolley and the animated figure, wherein the controller is configured to:

detect a presence of a ride vehicle or a guest proximate to the track based on sensor data received by the controller from one or more sensors proximate to the track;

control the trolley to position the animated figure based on the presence of the ride vehicle or the guest; and control animation of the animated figure by operating the reaction control element.

2. The reaction controlled system of claim 1, wherein the controller is configured to control the animation of the animated figure by moving the trolley in conjunction with operating the reaction control element to rotate the animated figure, lean the animated figure, move the animated figure in one or more dimensions within a linear axes system comprised of an x-axis, a y-axis, and a z-axis which are all perpendicular to each other, or any combination thereof.

3. The reaction controlled system of claim 1, wherein the track comprises a plurality of rails and the trolley is coupled to the animated figure via a cable.

4. The reaction controlled system of claim 3, wherein the trolley is configured to extend and retract the cable from the trolley to change a distance between the trolley and the animated figure.

5. The reaction controlled system of claim 4, wherein the trolley is configured to extend and retract the cable using a counterweight, a custom tensioning system, a winch, or any combination thereof.

6. The reaction controlled system of claim 1, wherein the track comprises a plurality of track portions arranged to facilitate movement of the trolley along two or more axes.

7. The reaction controlled system of claim 1, wherein the controller is configured to determine that the ride vehicle or the guest is within a threshold distance from the animated figure based on the sensor data received by the controller from the one or more sensors proximate to the animated figure.

8. The reaction controlled system of claim 7, wherein the one or more sensors comprise a radio frequency integrated device (RFID) tag, a camera, a weight sensor, an electronic reader configured to read the RFID tag, or any combination thereof.

9. The reaction controlled system of claim 1, wherein the at least one reaction control element comprises a plurality of propellers coupled to respective portions of the animated figure, wherein the respective portions are configured to move relative to one another.

10. The reaction controlled system of claim 9, wherein the controller is configured to manage the plurality of propellers based on an animation determined based on a detected location of the ride vehicle or the guest.

11. The reaction controlled system of claim 10, wherein the animation comprises moving one or more extremities of the animated figure using the plurality of propellers.

12. A method for moving an animated figure, the method comprising:

determining a presence of a ride vehicle or a guest proximate to a path based on sensor data received from one or more sensors proximate to the path;

determining a desired location for the animated figure based on the presence of the ride vehicle or the guest, wherein the animated figure is coupled to a trolley configured to travel along the path;

moving the trolley along the path based on the desired location;

determining an animation for the animated figure;

determining one or more components of the animated figure to move relative to other components of the animated figure based on the animation; and maneuvering the one or more components of the animated figure relative to the other components of the animated figure by controlling one or more reaction controlled elements coupled with, disposed on, or integrated with the one or more components of the animated figure.

13. The method of claim 12, wherein the one or more components comprise one or more limbs of the animated figure that couple to a body of the animated figure via hinges.

14. The method of claim 12, wherein the one or more reaction controlled elements comprise a propeller, an unmanned aerial vehicle, an electric ducted fan, a pneumatic device, a gyroscope device, or any combination thereof.

15. The method of claim 12, comprising moving the trolley horizontally or vertically along the path to provide corresponding movement of the animated figure.

16. The method of claim 12, comprising actuating a winch on the trolley to facilitate vertical movement of the animated figure relative to the trolley.

17. The method of claim 12, wherein the one or more reaction controlled elements comprise a plurality of propellers, and the method comprising coordinating operation of the plurality of propellers to provide the animation.

18. The method of claim 17, comprising moving the trolley along the path by activating the one or more reaction controlled elements.

19. A tangible, non-transitory, machine readable medium, comprising machine-readable instructions that, when executed by one or more processors, cause the one or more processors to:

detect a presence of a guest or a ride vehicle proximate to a path based on sensor data received from one or more sensors proximate to the path;

position a trolley along the path based on the detected presence, wherein the trolley is coupled to an animated figure, and wherein the trolley is configured to travel along the path;

determine at least one component of the animated figure to control based on an animation; and in response to determining the at least one component, operating the trolley and at least one reaction controlled element associated with the at least one component to provide the animation, wherein the at least one reaction controlled element is onboard the animated figure, connected to the animated figure via a rod, or a combination thereof.

20. The tangible, non-transitory, machine readable medium of claim 19, comprising machine-readable instructions that, when executed by one or more processors, cause the one or more processors to control rotation of propellers, wherein the propellers are the at least one reaction controlled element.

* * * * *